US010269363B2

(12) United States Patent
Fukui et al.

(10) Patent No.: US 10,269,363 B2
(45) Date of Patent: Apr. 23, 2019

(54) CODING METHOD, DECODING METHOD, APPARATUS, PROGRAM, AND RECORDING MEDIUM

(75) Inventors: Masahiro Fukui, Tokyo (JP); Shigeaki Sasaki, Tokyo (JP); Yusuke Hiwasaki, Tokyo (JP); Shoichi Koyama, Tokyo (JP); Kimitaka Tsutsumi, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 1046 days.

(21) Appl. No.: 13/583,427

(22) PCT Filed: Feb. 7, 2011

(86) PCT No.: PCT/JP2011/052541
§ 371 (c)(1),
(2), (4) Date: Oct. 4, 2012

(87) PCT Pub. No.: WO2011/111453
PCT Pub. Date: Sep. 15, 2011

(65) Prior Publication Data

US 2013/0034168 A1 Feb. 7, 2013

(30) Foreign Application Priority Data

Mar. 9, 2010 (JP) ..... 2010-051820

(51) Int. Cl.
*G10L 19/038* (2013.01)

(52) U.S. Cl.
CPC ..... *G10L 19/038* (2013.01)

(58) Field of Classification Search
USPC ..... 375/240.22
See application file for complete search history.

(56) References Cited

U.S. PATENT DOCUMENTS 5,247,357 A * 9/1993 Israelsen ..... H03M 7/3082 341/106
6,081,565 A * 6/2000 Marandi ..... H03G 3/001 333/128

(Continued)

FOREIGN PATENT DOCUMENTS

JP 1 233891 9/1989
JP 7 261800 10/1995

(Continued)

OTHER PUBLICATIONS

International Search Report dated Apr. 19, 2011 in PCT/JP11/52541 filed Feb. 7, 2011.

(Continued)

*Primary Examiner* — Behrooz M Senfi
*Assistant Examiner* — Ana Picon-Feliciano
(74) *Attorney, Agent, or Firm* — Oblon, McClelland, Maier & Neustadt, L.L.P.

(57) ABSTRACT

A normalization value calculator 12 calculates a normalization value that is representative of a predetermined number of input samples. A normalization value quantizer 13 quantizes the normalization value to obtain a quantized normalization value and a normalization-value quantization index corresponding to the quantized normalization value. An quantization-candidate calculator 14 subtracts a value corresponding to the quantized normalization value from a value corresponding to the magnitude of each of the samples to obtain a difference value and, when the difference value is positive and the value of each of the samples is positive, sets the difference value as an quantization candidate corresponding to the sample. When the difference value is positive and the value of each of the samples is negative, the quantization-candidate calculator 14 reverses the sign of the difference value and setting the sign-reversed value as an quantization candidate corresponding to the sample. When (Continued)

the difference value is not positive, the quantization-candidate calculator 14 sets 0 as an quantization candidate corresponding to the sample. A vector quantizer 15 jointly vector-quantizes a plurality of quantization candidates corresponding to a plurality of samples to obtain a vector quantization index.

30 Claims, 6 Drawing Sheets

(56) References Cited

U.S. PATENT DOCUMENTS 6,415,251 B1 * 7/2002 Oikawa ..... G10L 19/0208 704/200.1
6,678,648 B1 * 1/2004 Surucu ..... G10L 19/035 704/200.1
2005/0261893 A1 * 11/2005 Toyama ..... G10L 19/02 704/201

FOREIGN PATENT DOCUMENTS

| | | |
|---|---|---|
| JP | 2007 226036 | 9/2007 |
| JP | 2009 188724 | 8/2009 |
| JP | 2011 9860 | 1/2011 |
| JP | 2011 9861 | 1/2011 |
| JP | 2011 9868 | 1/2011 |
| JP | 2011 9869 | 1/2011 |

OTHER PUBLICATIONS

U.S. Appl. No. 13/806,913, filed Dec. 26, 2012, Fukui, et al.
U.S. Appl. No. 13/807,098, filed Dec. 27, 2012, Fukui, et al.
Office Action dated Mar. 18, 2015 in European Patent Application No. 11 753 115.2.

* cited by examiner

CODING METHOD, DECODING METHOD, APPARATUS, PROGRAM, AND RECORDING MEDIUM

TECHNICAL FIELD

The present invention relates to a technique to encode or decode signal sequences, such as audio and video signal sequences, by vector quantization.

BACKGROUND ART

In a coding apparatus described in Patent literature 1, an input signal is first normalized by division by a normalization value. The normalization value is quantized to generate a quantization index. The normalized input signal is vector-quantized to generate the index of a representative quantization vector. The generated indexes, which are the quantization index and the index of the representative quantization vector, are output to a decoding apparatus.

The decoding apparatus decodes the quantization index to generate a normalization value. The decoding apparatus also decodes the index of the representative quantization vector to generate a decoded signal. The normalized decoded signal is multiplied by the normalization value to generate a decoded signal.

CITATION LIST

Patent Literature

Patent literature 1: Japanese Patent Application Laid-Open No. 07-261800

DISCLOSURE OF THE INVENTION

Problems to be Solved by the Invention

High-performance vector quantization methods that produces the low quantization noise, such as SVQ (Spherical Vector Quantization (SVQ, see G.729.1), are well-known vector-quantization methods that assign pulses within a preset given quantization bit rate.

When the vector-quantization method is used in the coding and decoding apparatuses described in Patent literature 1 in the case where an input signal is a frequency-domain signal, for example, the lack of available bit budget used to quantize all frequency components can cause spectral holes. The spectral hole indicates a frequency component loss of when some frequency components are not present in an output signal but those are present in an input signal. As a result of the spectral hole, if a pulse of a certain frequency component is assigned or not in consecutive frames, so-called musical noise can be caused.

An object of the present invention is to provide a coding method, a decoding method, an apparatus, a program and a recording medium for reducing musical noise which can occur when an input signal is a frequency-domain signal, for example.

Means to solve the Problems

In coding, a normalization value that is representative of a predetermined number of input samples is calculated. The normalization value is quantized to obtain a quantized normalization value, and a normalization-value quantization index corresponding to the quantized normalization value is obtained. A value corresponding to the quantized normalization value is subtracted from a value corresponding to the magnitude of the value of each sample to obtain a difference value. When the difference value is positive and the value of the sample is positive, the difference value is set as the quantization candidate corresponding to the sample; when the difference value is positive and the value of the sample is negative, the sign of the difference value is reversed and is set as the quantization candidate corresponding to the sample; and when the difference value is not positive, zero is set as the quantization candidate corresponding to the sample. A plurality of quantization candidates corresponding to a plurality of samples are jointly vector-quantized to obtain a vector quantization index.

In decoding, a decoded normalization value corresponding to an input normalization-value quantization index is obtained. A plurality of values corresponding to an input vector quantization index are obtained as a plurality of decoded values. Calculation is performed to obtain a recalculated normalization value that decreases with increasing sum of the absolute values of a predetermined number of decoded values. When a decoded value is positive, the decoded value and the decoded normalization value are added together and when a decoded value is negative, the absolute values of the decoded value and the decoded normalization value are added together and the sign of the resulting value is reversed; when a decoded value is zero, the recalculated normalization value is multiplied by a first constant.

Effects of the Invention

In coding, by selecting some dominant components from all frequency components and by actively quantizing them, occurrence of spectral holes related to the dominant components can be prevented and the musical noise can be reduced.

In decoding, by assigning a non-zero value based on a recalculated normalization value when a decoded value is zero, a spectral hole which can occur if, for example, an input signal is a frequency-domain signal can be prevented and the musical noise can be reduced.

DETAILED DESCRIPTION OF THE EMBODIMENTS

An embodiment of the present invention will be descried below in detail.

Figure 1:
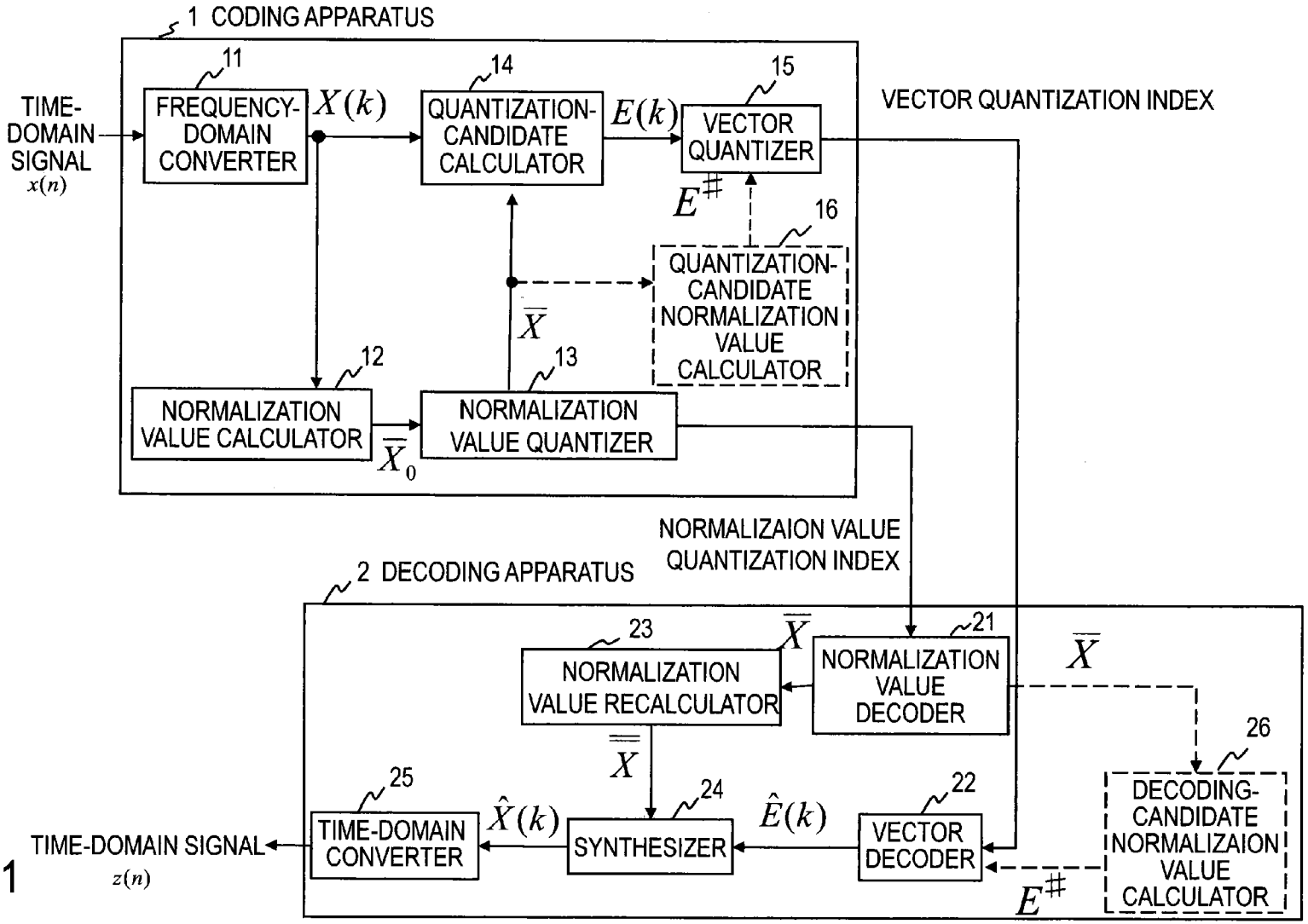
FIG. 1 is a functional block diagram of an exemplary coding apparatus and an exemplary decoding apparatus.

A coding apparatus 1 includes a normalization value calculator 12, a normalization value quantizer 13, a quantization-candidate calculator 14, and a vector quantizer 15, for example, as illustrated in FIG. 1. A decoding apparatus 2 includes a normalization value decoder 21, a vector decoder 22, a normalization value recalculator 23, and a synthesizer 24, for example, as illustrated in FIG. 1. The coding apparatus 1 may include a frequency-domain converter 11 and a quantization-candidate normalization value calculator 16, for example, as required. The decoding apparatus 2 may include a time-domain converter 25 and a decoding-candidate normalization value calculator 26, for example.

Figure 2:
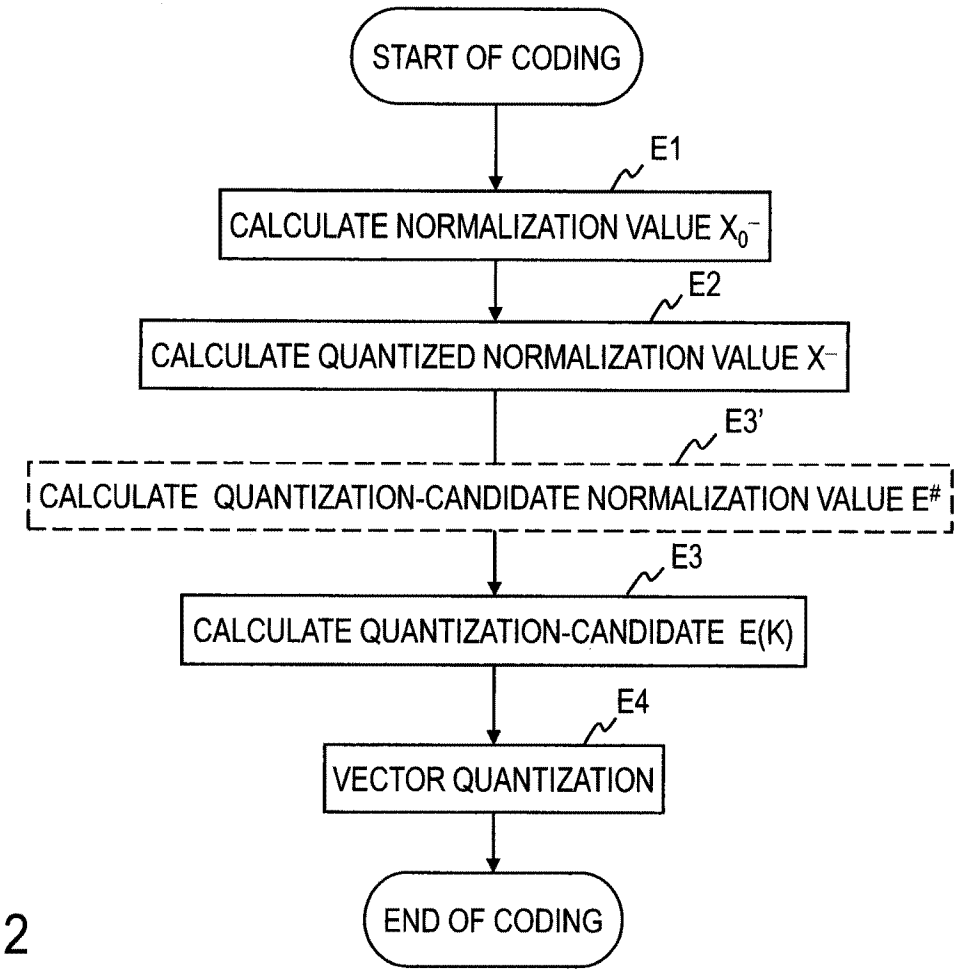
FIG. 2 is a flowchart of an exemplary coding method.
Figure 4:
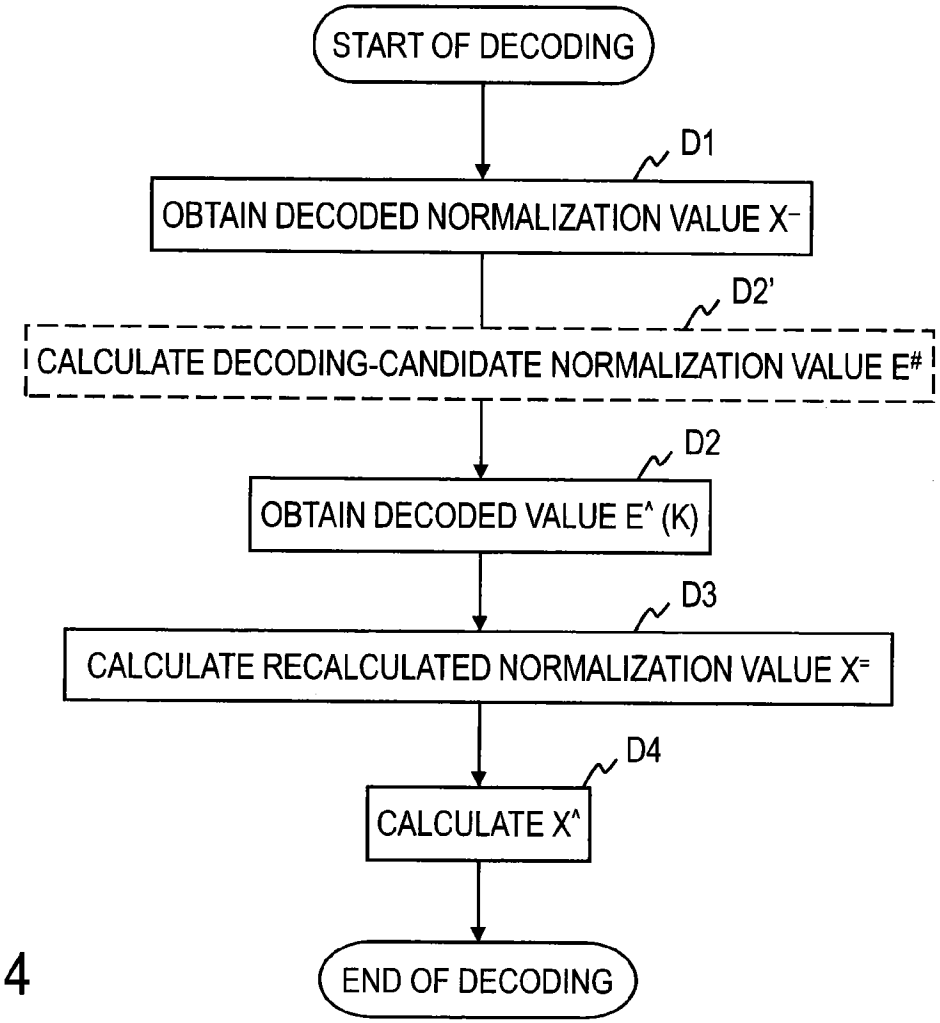
FIG. 4 is a flowchart of an exemplary decoding method.

The coding apparatus 1 executes the steps of a coding method illustrated in FIG. 2 and the decoding apparatus 2 executes the steps of a decoding method illustrated in FIG. 4.

An input signal X (k) is input into the normalization value calculator 12 and quantization-candidate calculator 14. The input signal X (k) in this example is a frequency-domain signal resulting from conversion into a frequency domain by the frequency-domain converter 11.

The frequency-domain converter 11 converts an input time-domain signal x (n) to a frequency-domain signal X (k) by MDCT (Modified Discrete Cosine Transform), etc., and outputs the frequency-domain signal X (k). Here, n is a number of a signal in a time domain (a discrete-time number) and k is a number of a signal in a frequency domain (a discrete-frequency number). Suppose that one frame includes L samples. The time-domain signal x (n) is converted to a frequency domain signal per each frame to generate frequency-domain signals X (k) (k=0, 1, . . . L−1) that constitute L frequency components. Here, L is a predetermined positive number, for example 64 or 80.

The normalization value calculator 12 calculates a normalization value $X_0^-$ that is representative value of a predetermined number $C_0$ of input samples (step E1). Here, $X_0^-$ is the character $X_0$ with an overbar. The calculated $X_0^-$ is sent to the normalization value quantizer 13.

Here, $C_0$ is L or a common divisor of L other than 1 and L. If $C_0$ is a common divisor of L, it means that L frequency components are divided into sub-bands and a normalization value is calculated per each sub-band.

For example, if L=80 and one sub-band is composed of eight frequency components, 10 sub-bands are formed and a normalization value is calculated per each sub-band. The following describes using $C_0$=L as an example.

The normalization value $X_0^-$ is a representative value of $C_0$ samples and an average value of powers of the $C_0$ samples, for example.

[Equation 1]

$$\overline{X}_0 = \sqrt{\frac{\sum_{k=0}^{C_0-1} X(k)^2}{C_0}}$$

The normalization value quantizer 13 quantizes the normalization value $X_0^-$ to obtain a quantized normalization value $X^-$ and obtains a normalization-value quantization index corresponding to the quantized normalization value $X^-$ (step E2). Here, $X^-$ is the character X with an overbar. The quantized normalization value $X^-$ is sent to the quantization-candidate calculator 14 and the normalization-value quantization index is sent to the decoding apparatus 2.

The quantization-candidate calculator 14 subtracts a value corresponding to the quantized normalization value from a value corresponding to the magnitude of the each sample value X (x) of the input signal to obtain the difference value $E^-$ (k). If the difference value $E^-$ (k) is positive and the each sample value X (k) is positive, the quantization-candidate calculator 14 sets the difference value $E^-$ (k) as the quantization candidate E (k) corresponding to the sample. If the difference value $E^-$ (k) is positive and the each sample value X (k) is negative, the quantization-candidate calculator 14 reverses the sign of the difference value and sets the sign-reversed value as the quantization candidate E (k) corresponding to the sample. If the difference value $E^-$ (k) is not positive, the quantization-candidate calculator 14 sets 0 as the quantization candidate E (k) corresponding to the sample (step S3). The quantization candidate E (k) is sent to the vector quantizer 15.

Figure 3:
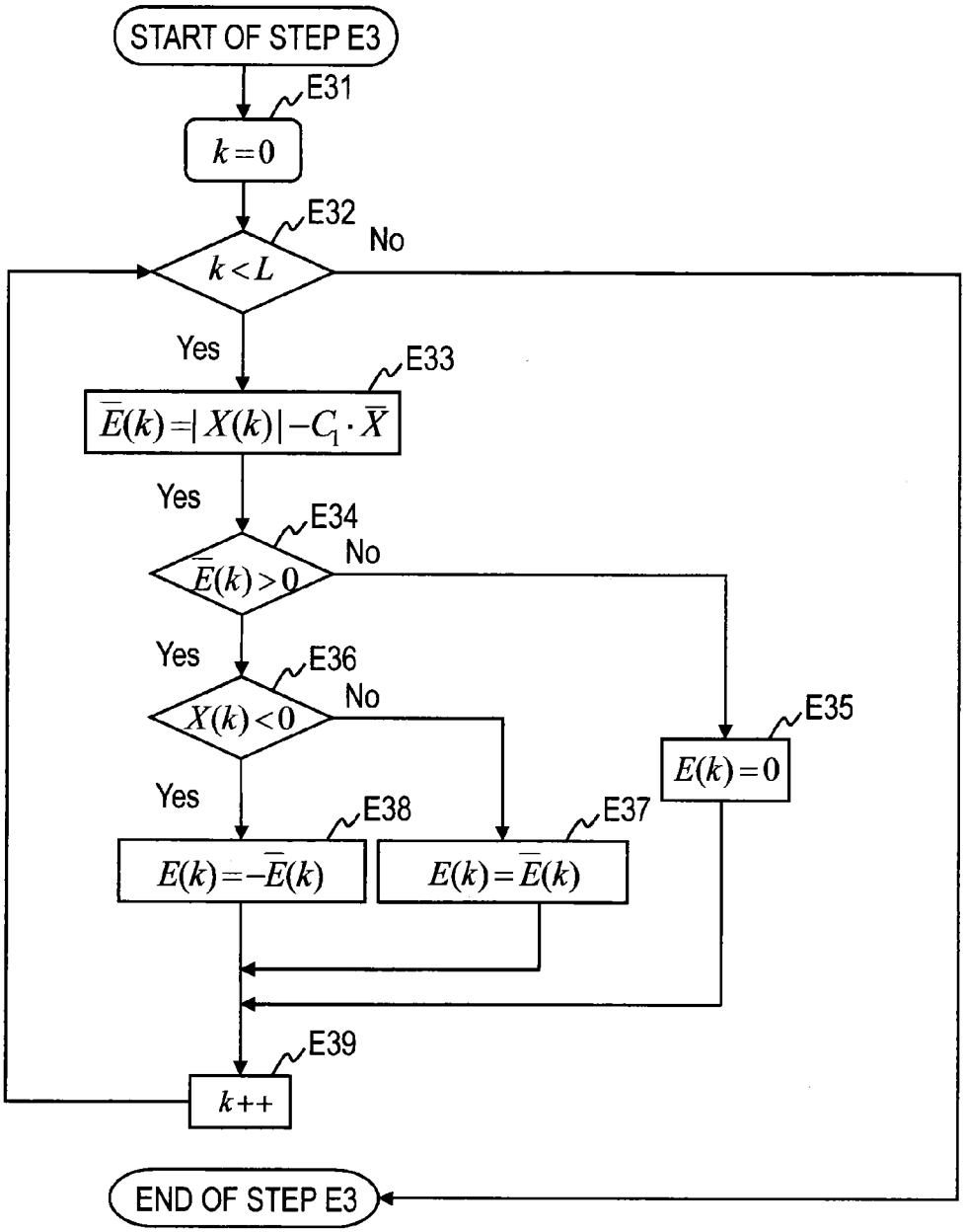
FIG. 3 is a flowchart of an example of step E3.

In particular, the quantization-candidate calculator 14 performs the operations illustrated in FIG. 3 to determine the quantization candidate E (k) corresponding to the each sample value X (k) of the input signal.

The quantization-candidate calculator 14 initializes character k as k=0 (step E31).

The quantization-candidate calculator 14 compares k with L (step E32). If k<L, the process proceeds to step E33; otherwise the process at step E3 exits.

The quantization-candidate calculator 14 calculates the difference value $E^-$ (k) between the absolute value of the each sample value X (k) of the input signal and the quantized normalization value (step E33). Here, $E^-$ is the character E with an overbar. For example the quantization-candidate calculator 14 calculates the value of $E^-$ (k) defined by Equation 1 given below. Here, $C_1$ is an adjustment constant for adjusting the normalization value and takes on a positive value. For example, $C_1$=1.0.

[Equation 2]

$$\overline{E}(k)=|X(k)|-C_1\cdot\overline{X} \quad (1)$$

Thus, the value corresponding to the each sample value X (k) is for example the absolute value |X (k)| of the value X (k) of that sample. The value corresponding to the quantized normalization value $X^-$ is for example the product of the quantized normalization value $X^-$ and the adjustment constant $C_1$.

The quantization-candidate calculator 14 compares the difference value $E^-$ (k) with zero (step E34). If not difference value $E^-$ (k)>0, the quantization-candidate calculator 14 sets zero as the quantization candidate E (k) (step E35).

If difference value $E^-$ (k)>0, the quantization-candidate calculator 14 compares X (k) with zero (step E36).

If not X (k)<0, the quantization-candidate calculator 14 sets the difference value $E^-$ (k) as the quantization candidate E (k) (step E37).

If X (k)<0, the quantization-candidate calculator 14 reverses the sign of the difference value $E^-$ (k) and sets the sign-reversed value $-E^-$ (k) as the quantization candidate E (k) (step E38).

The quantization-candidate calculator 14 increments k by 1 (step E39) and then proceeds to step E32.

In this way, the quantization-candidate calculator 14 subtracts the value corresponding to the quantized normalization value from the value corresponding to the magnitude of a sample value and selects the greater value of the difference value or 0, and sets the value obtained by multiplying the selected value by the sign of that sample value as the quantization candidate.

The vector quantizer 15 jointly vector-quantizes a plurality of quantization candidates E (k) corresponding to a plurality of samples to obtain a vector quantization index (step E4). The vector quantization index is sent to the decoding apparatus 2.

The vector quantization index represents a representative quantization vector. For example, the vector quantizer 15 selects a representative quantization vector closest to a vector composed of a plurality of quantization candidates E (k) corresponding to a plurality of samples from among a plurality of representative quantization vectors stored in a vector codebook storage not shown in the figure. And the vector quantizer 15 outputs a vector quantization index representing the selected representative quantization vector to accomplish vector quantization.

The vector quantizer 15 jointly vector-quantizes the quantization candidates E (k) corresponding to $C_0$ samples, for example. The vector quantizer 15 uses a vector quantization method such as SVQ (Spherical Vector Quantization, see G.729.1) to perform the vector quantization. However, the vector quantizer 15 may use other vector quantization method.

In this way, if for example an input signal is a frequency-domain signal, dominant components are selected from among all frequencies and actively quantized. Thereby occurrence of a spectral hole in dominant components can be prevented and the musical noise can be reduced.

The normalization value decoder 21 calculates a decoded normalization value $X^-$ corresponding to a normalization-value quantization index which is input into the decoding apparatus 2 (step D1). The decoded normalization value $X^-$ is sent to the normalization value recalculator 23. It is assumed here that normalization values individually corresponding to a plurality of normalization-value quantization indices are stored in a codebook storage not shown in the figure. The normalization value decoder 21 searches the codebook storage using the input normalization-value quantization index as a key to obtain a normalization value corresponding to the normalization-value quantization index and sets the obtained value as a decoded normalization value $X^-$.

The vector decoder 22 obtains a plurality of values corresponding to the vector quantization index, which is input into the decoding apparatus 2, and sets them as a plurality of quantized values $\hat{E}$ (k) (step D2). Here, $\hat{E}$ is the character E with a hat. The decoded value $\hat{E}$ (k) is sent to the synthesizer 24.

It is assumed here that the vector codebook storage not shown in the figure contains the representative quantization vectors individually corresponding to a plurality of vector quantization indices. The vector decoder 22 searches the vector codebook storage using the representative quantization vector corresponding to the input vector quantization index as a key to obtain the representative quantization vector corresponding to the vector quantization index. The components of the representative quantization vector are a plurality of values corresponding to the input vector quantization index.

The normalization value recalculator 23 calculates a recalculated normalization value $X^=$ that takes on a value that decreases with increasing sum of the absolute values of a predetermined number of decoded values $\hat{E}$ (k) (step D3). The recalculated normalization value $X^=$ is sent to the synthesizer 24. The recalculated normalization value $X^=$ is the character X with a double overbar.

Figure 5:
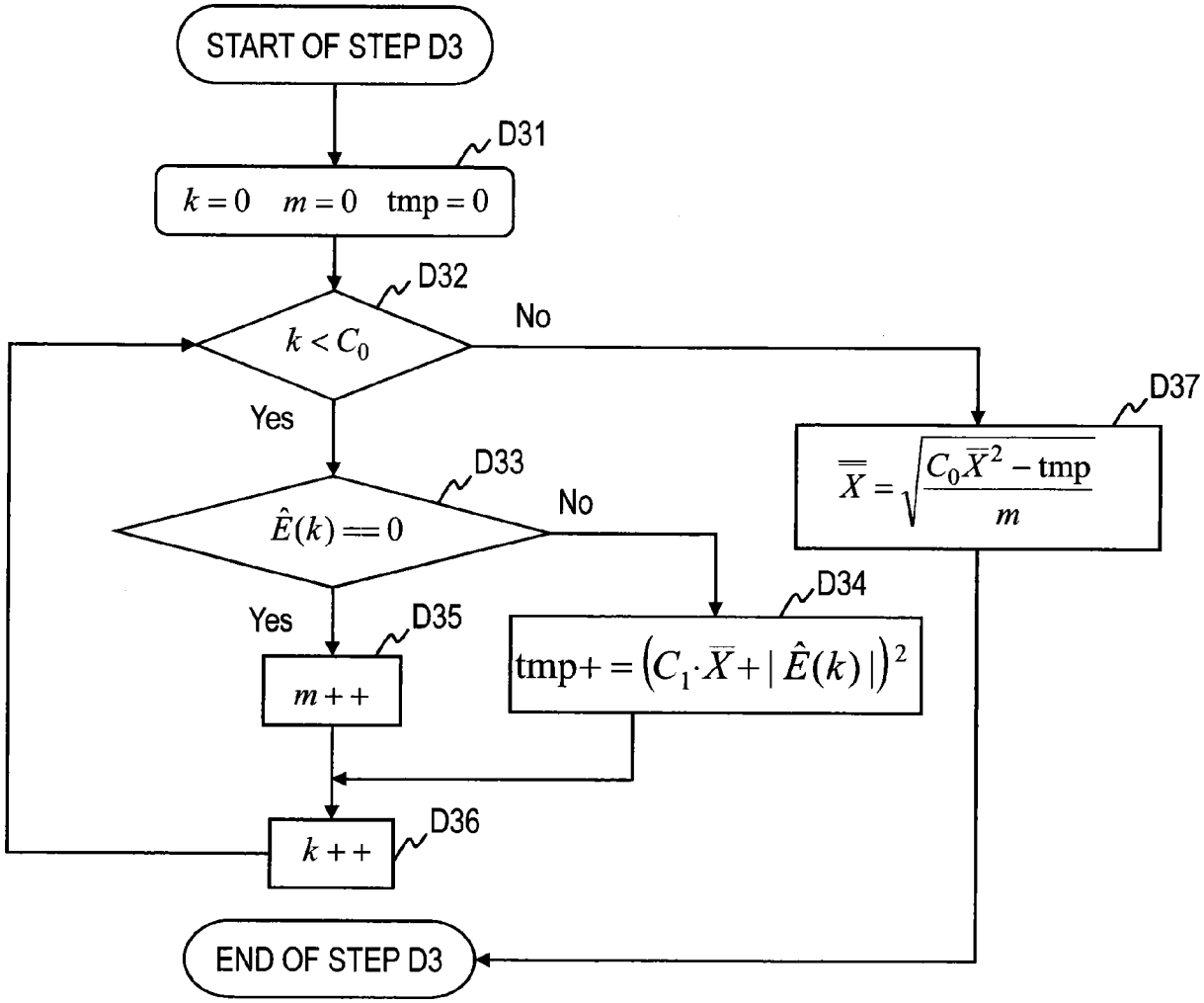
FIG. 5 is a flowchart of an example of step D3.

In particular, the normalization value recalculator 23 performs the operations illustrated in FIG. 5 to obtain the recalculated normalization value $X^=$. The recalculated normalization value $X^=$ denotes a representative value of samples whose quantization candidates E (k) were set to 0 in coding. In this example, the recalculated normalization value $X^=$ is calculated by subtracting the sum tmp of the powers of samples whose quantization candidate E (k) were not set to 0 in coding from the sum $C_0X^{-2}$ of the powers of all samples, by dividing the difference by the number m of the samples whose quantization candidates E (k) were set to 0, and by extracting the square root of the quotient, as shown in Equation (2) given below.

The normalization value recalculator 23 initializes the characters k, m and tmp as k=0, m=0 and tmp=0 (step D31).

The normalization value recalculator 23 compares k with $C_0$ (step D32).

If $k \geq C_0$, the value of $X^=$ defined by the following equation is calculated (step D37), then the process at step D3 exits.

[Equation 3]

$$\overline{\overline{X}} = \sqrt{\frac{C_0\overline{X}^2 - tmp}{m}} \tag{2}$$

If $k<C_0$, the normalization value recalculator 23 compares the decoded value $\hat{E}$ with zero (step D33). If the decoded value $\hat{E}$ (k) is zero, the normalization value recalculator 23 increments m by 1 (step D35), then proceeds to step D36. If the decoded value $\hat{E}$ (k) is not zero, the normalization value recalculator 23 proceeds to step D34.

The normalization value recalculator 23 calculates the power of the sample with number k and adds the power to tmp (step D34). The normalization value recalculator 23 then proceeds to step D36. That is, the sum of the calculated power and the value of tmp is set as a new value of tmp. The power is calculated according to the following equation, for example.

$$(C_1 \cdot \overline{X} + |\hat{E}(k)|)^2 \qquad \text{[Equation 4]}$$

The normalization value recalculator 23 increments k by 1 (step D36), then proceeds to step D32.

When a decoded value $\hat{E}$ (k) is positive, the synthesizer 24 adds the decoded value $\hat{E}$ (k) to the decoded normalization value $X^-$, when a decoded value $\hat{E}$ (k) is negative, the synthesizer 24 reverses the sign of the sum of the absolute value of the decoded value $\hat{E}$ (k) and the decoded normalization value $X^-$; if the decoded value $\hat{E}$ (k) is zero, the synthesizer 24 multiplies the recalculated normalization value $X^=$ by a first constant $C_3$ and randomly reverse the sign of the product to obtain a decoded signal value $\hat{X}$ (k) (step D4).

Figure 6:
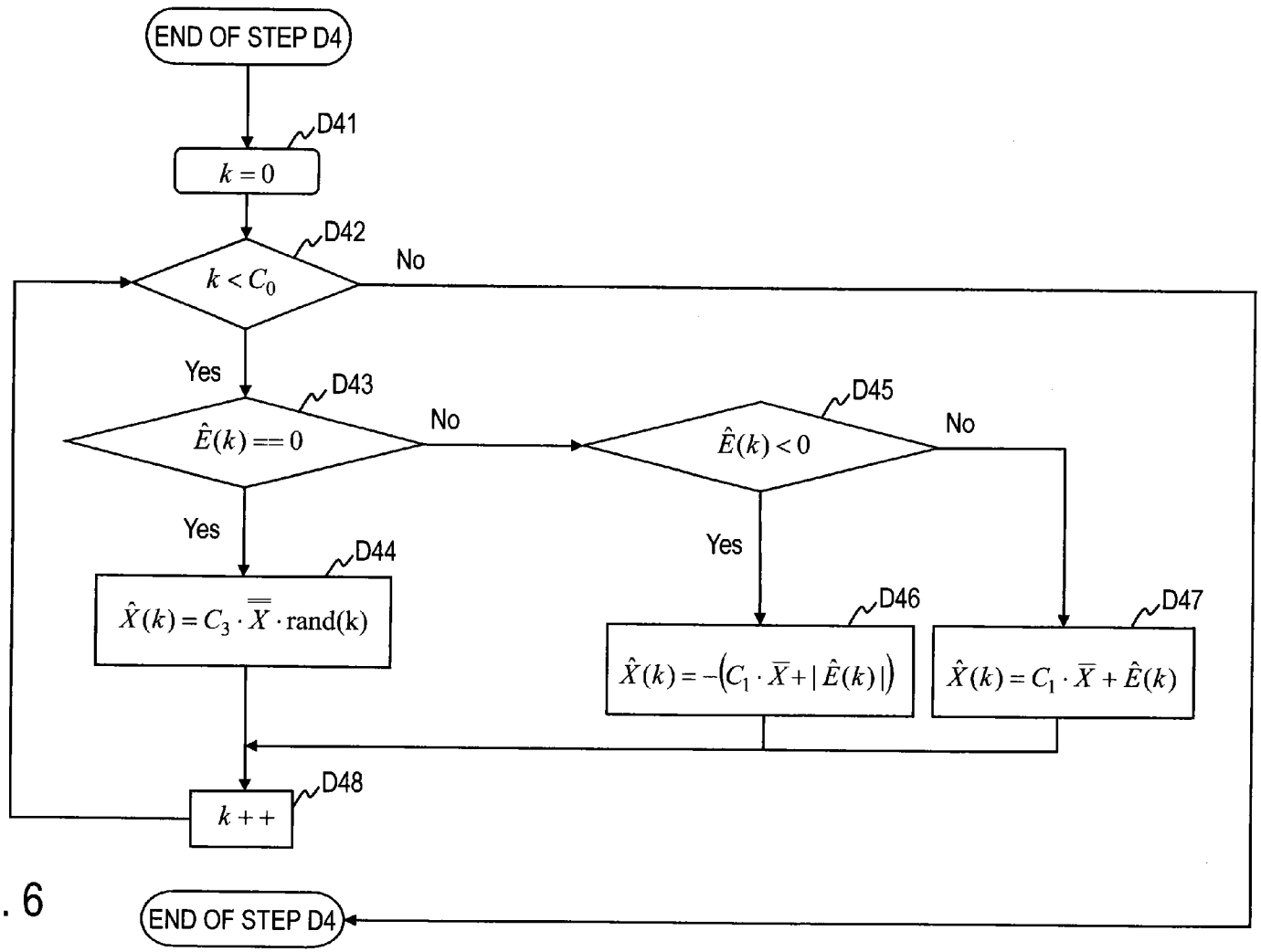
FIG. 6 is a flowchart of an example of step D4.

In particular, the synthesizer 24 performs the operations illustrated in FIG. 6 to obtain a decoded signal.

The synthesizer 24 initializes character k as k=0 (step D41).

The synthesizer 24 compares k with $C_0$ (step D2). If not $k<C_0$, the process at step D4 exits.

If $k<C_0$, the synthesizer 24 compares the decoded value $\hat{E}$ (k) with zero. If the decoded value $\hat{E}$ (k) is zero, the synthesizer 24 multiplies the recalculated normalization value $X^=$ by the first constant $C_3$ and randomly reverses the sign of the product to obtain the value $\hat{X}$ (k) of the decoded signal (step D44). That is, the value defined by the equation given below is calculated as $\hat{X}$ (k). Here, $C_3$ is a constant for adjusting the magnitude of the frequency component and may be 0.9, for example, and rand (k) is a function that outputs 1 or −1, for example randomly outputs 1 or −1 based on random numbers.

In this way, the synthesizer 24 obtains $\hat{X}$ (k) whose absolute value is set to the value obtained by multiplying the recalculated normalization value $_{96}X^=$ by the first constant $C_3$.

$$\hat{X}(k) = C_3 \cdot \overline{X} \cdot \text{rand}(k) \qquad \text{[Equation 5]}$$

If the synthesizer 24 determines at step D43 that the decoded value $\hat{E}$ (k) is not zero, the synthesizer 24 compares the decoded value $\hat{E}$ (k) with zero (step D45).

If the decoded value $\hat{E}$ (k)<0, the synthesizer 24 reverses the sign of the sum of the absolute value $|\hat{E}$ (k)| of the decoded value $\hat{E}(k)$ and the decoded normalization value $\bar{X}$ to obtain a value $\hat{X}(k)$ of the decoded signal (step D46). That is, the value defined by the following equation is calculated as $\hat{X}(k)$.

$$\hat{X}(k)=-(C_1\cdot\bar{X}+|\hat{E}(k)|) \quad \text{[Equation 6]}$$

If not decoded value $\hat{E}(k)<0$, the synthesizer 24 adds the decoded value $\hat{E}(k)$ to the decoded normalization value $\bar{X}$ and sets the sum as $\hat{X}(k)$ (step D47).

$$\hat{X}(k)=C_1\cdot\bar{X}+\hat{E}(k) \quad \text{[Equation 7]}$$

In this way, if not $\hat{E}(k)=0$, the synthesizer 24 calculates $\hat{X}(k)$ that is determined by $\hat{X}(k)=\sigma(\hat{E}(k))\cdot(C_1\cdot_{\tau}\hat{X}+|\hat{E}(k)|)$. Here, $\sigma(\cdot)$ is the sign of ·.

After determining $\hat{X}(k)$, the synthesizer 24 increments k by 1 (step D48), then proceeds to step D42.

If $\hat{X}(k)$ is the frequency-domain signal, the time-domain converter 25 converts $\hat{X}(k)$ to the time-domain signal z (n) by the inverse Fourier transform etc.

In this way, if the decoded value $\hat{E}(k)$ is zero, the recalculated normalization value $\bar{X}$ is used to assign the non-zero value as appropriate. Accordingly, spectral holes caused when the input signal is the frequency-domain signal can be eliminated. As a result, musical noise can be reduced.

The value assigned when the decoded value $\hat{E}(k)$ is zero is not always positive or negative. A more natural decoded signal can be produced by using the function rand (k) to randomly change the sign.

[Variations]

At step D3, if the recalculated normalization value $X'^{=}$ previously calculated is not zero, the normalization value recalculator 23 may obtain a weighted sum of the recalculated normalization value $\bar{X}$ and the previously recalculated normalization value $X'^{=}$ as the recalculated normalization value $\bar{X}$. If the recalculated normalization value $X'^{=}$ is zero, the weighted summing of the recalculated normalization values does not need to be performed. That is, if the recalculated normalization value X' is zero, smoothing of the recalculated normalization value does not need to be performed.

If $C_0=L$ and a recalculated normalization value $\bar{X}$ is calculated per each frame, the previously recalculated normalization value $X'^{=}$ is a recalculated normalization value calculated by the normalization value recalculator 23 for the immediately preceding frame. If $C_0$ is a divisor of L other than 1 and L and frequency components are divided into $L/C_0$ sub-bands and a recalculated normalization value is calculated per each sub-band, the previously recalculated normalization value $X'^{=}$ may be a recalculated normalization value calculated for the same sub-band in the previous frame or may be a recalculated normalization value already calculated for the preceding or succeeding adjacent sub-band in the same frame.

The recalculated normalization value $X_{post}^{=}$ newly calculated by considering the previously recalculated normalization value $X'^{=}$ can be expressed by the equation given below, where α and β are adjustment coefficients which are determined as appropriate according to the desired performance and specifications. For example, α=β=0.5.

$$\begin{cases} \bar{X}_{POST}=\bar{X} \text{ if } \bar{X}'=0 \\ \bar{X}_{POST}=\alpha\bar{X}+\beta\bar{X}' \text{ otherwise} \end{cases} \quad \text{[Equation 8]}$$

By obtaining a recalculated normalization value considering the previously recalculated normalization value $X'^{=}$, the newly recalculated normalization value will be closer to the previously recalculated normalization value $X'^{=}$. As a result the continuity between these values will increase and therefore the musical noise caused when the input signal is the frequency-domain signal, etc., can be further reduced.

As indicated by a dashed line in FIG. 1, the quantization-candidate normalization value calculator 16, which calculates the quantization-candidate normalization value $E^{\#}$ as the representative of the quantization candidates E (k), may be provided in the coding apparatus 1. And the vector quantizer 15 may jointly vector-quantize normalized values in order to obtain the vector quantization index, the normalized values obtained by normalizing a plurality of the quantization candidates E (k) corresponding to a plurality of samples with the quantization-candidate normalization value E#. The normalization of the quantization candidates E (k) before vector quantization can narrow the dynamic range of vector quantization candidates. Accordingly, coding and decoding can be performed with a reduced number of bits.

The quantization-candidate normalization value calculator 16 uses the quantized normalization value $\bar{X}$ to calculate the value defined by the equation given below, for example, as an quantization candidate E (k), (step E3'). Here, $C_2$ is a positive adjustment coefficient (also referred to as a second constant), which may be 0.3, for example.

$$E^{\#}=C_2\cdot\bar{X} \quad \text{[Equation 9]}$$

In this way, an quantization-candidate normalization value $E^{\#}$ can be calculated from only quantized normalization value $\bar{X}$ even at the decoding side without information transmission for the quantization-candidate normalization value E#. The need for transmitting information of the quantization-candidate normalization value $E^{\#}$ is thus eliminated and so the communication traffic can be reduced.

In this case, the decoding-candidate normalization value calculator 26 is provided in the decoding apparatus 2 as indicated by dashed line in FIG. 1. The decoding-candidate normalization value calculator 26 multiplies a decoded normalization value $\bar{X}$ by a second constant $C_2$ to obtain the decoding-candidate normalization value $E^{\#}$ (step D2'). The decoding-candidate normalization value $E^{\#}$ is sent to the vector decoder 22. The vector decoder 22 multiplies each of a plurality of values corresponding to the vector quantization index by the decoding-candidate normalization value $E^{\#}$ to obtain a plurality of decoded values $\hat{E}(k)$.

The input signal X (k) does not necessarily need to be a frequency-domain signal; it may be any signal such as a time-domain signal. That is, the present invention can be used in coding and decoding of any signals beside frequency-domain signals.

$C_0$, $C_1$, $C_2$ and $C_3$ may be changed as appropriate according to desired performance and specifications.

The steps of the coding and decoding method can be implemented by a computer. The operations of processes at the steps are described in a program. The program is executed on the computer to implement the steps on the computer.

The program describing the operations of the processes can be stored in a computer-readable recording medium. At least part of the operations of the processes may be implemented by hardware.

The present invention is not limited to the embodiment described. Modifications can be made as appropriate without departing from the spirit of the present invention.

What is claimed is:

1. A coding method implemented by an encoding apparatus for coding an audio signal comprising:

performing, by processing circuitry of the encoding apparatus, receiving an audio signal in the time domain and converting the audio signal to the frequency domain;

a normalization value calculation step of receiving the audio signal in the frequency domain as an input and calculating a normalization representative value representative of a predetermined number of input samples;

a normalization value quantization step of quantizing the normalization value to obtain a quantized normalization value and a normalization-value quantization index corresponding to the quantized normalization value;

a quantization-candidate calculation step of subtracting a value corresponding to the quantized normalization value from a value corresponding to the magnitude of each of the samples to obtain a difference value and, when the difference value is positive and the value of each of the samples is positive, setting the difference value as a quantization candidate corresponding to the sample, when the difference value is positive and the value of each of the samples is negative, reversing the sign of the difference value and setting the sign-reversed value as an quantization candidate corresponding to the sample, and when the difference value is not positive, setting 0 as an quantization candidate corresponding to the sample;

a vector quantization step of jointly vector-quantizing a plurality of quantization candidates corresponding to the plurality of samples to obtain a vector quantization index; and transmitting the normalization-value quantization index to a decoding apparatus.

2. The coding method according to claim 1, wherein:

the value corresponding to the magnitude of the sample is the absolute value of the value of the sample; and the value corresponding to the quantized normalization value is the product of the quantized normalization value and a first adjustment constant, the first adjustment constant being a predetermined positive value.

3. The coding method according to claim 1 or 2, further comprising an quantization-candidate normalization value calculation step of calculating a quantization-candidate normalization value, the quantization-candidate normalization value being representative of the quantization candidates;

wherein the vector quantization step jointly vector-quantizes normalized values to obtain a vector quantization index, the normalized values obtained by normalizing a plurality of quantization candidates corresponding to the plurality of samples with the quantization-candidate normalization value.

4. The coding method according to claim 3, wherein the quantization-candidate normalization value is the product of the quantized normalization value and a second predetermined adjustment constant.

5. A decoding method implemented by a decoding apparatus for decoding a coded audio signal comprising:

performing, by processing circuitry of the decoding apparatus, a normalization value decoding step of obtaining a decoded normalization value corresponding to an input normalization-value quantization index, the normalization-value quantization index being received from a coding apparatus and generated based on an audio signal inputted to the coding apparatus;

a vector decoding step of obtaining a plurality of values corresponding to an input vector quantization index as a plurality of decoded values;

a normalization value recalculation step of calculating a recalculated normalization value from decoded normalization values and decoded values those are not zero, the recalculated normalization value being specifically calculated to have a value which has a magnitude that is inversely related to a cumulative sum of the absolute values of a predetermined number of the decoded values;

a combining step of, when the decoded value is zero, obtaining as a decoded signal a value having an absolute value that is the recalculated normalization value multiplied by a first constant, and when the decoded value is not zero, obtaining as a decoded signal the linear sum of the decoded value or the absolute value of the decoded value and the decoded normalization value, the linear sum reflecting the sign of the decoded value;

wherein the decoded signal from the combining step is in the frequency domain, and the method further includes converting the decoded signal from the frequency domain to the time domain to reproduce an audio signal in the time domain that corresponds to the audio signal originally inputted to the coding apparatus.

6. The decoding method according to claim 5, wherein the value having an absolute value that is the recalculated normalization value multiplied by the first constant is the recalculated normalization value multiplied by the first constant and has a randomly reversed sign.

7. The decoding method according to claim 5, wherein:

the normalization value recalculation step calculates the recalculated normalization value that is $X^{=}$ defined by the following equation $$\overline{\overline{X}} = \sqrt{\frac{C_0 \overline{X}^2 - tmp}{m}} \quad \text{[Equation 10]}$$

where $C_0$ is the predetermined number, $X^{-}$ is the decoded normalization value, tmp is the sum of squares of the sum of the absolute value of a decoded value that is not zero among the predetermined number of decoded values and the decoded normalization value, and m is the number of decoded values that are zero among the predetermined number of decoded values.

8. The decoding method according to claim 5, wherein when each of the decoded values is not zero, the combining step adds the absolute value of the decoded value to the decoded normalization value multiplied by a first adjustment constant and multiplies the resulting value by the sign of the decoded value to obtain a decoded signal, the first adjustment constant being a predetermined positive value.

9. The decoding method according to claim 5, wherein when the recalculated normalization value is not zero, the normalization value recalculation step obtains as the recalculated normalization value a weighted sum of the recalculated normalization value and a recalculated normalization value obtained in the immediately preceding recalculation.

10. A coding apparatus for coding an audio signal comprising:

processing circuitry configured to implement a frequency domain converter that receives an audio signal in the time domain and converts the audio signal to the frequency domain;

a normalization value calculator that receives the audio signal in the frequency domain as an input and calculates a normalization representative value representative of a predetermined number of input samples;

a normalization value quantizer that quantizes the normalization value to obtain a quantized normalization value and a normalization-value quantization index corresponding to the quantized normalization value;

an quantization-candidate calculator that substracts a value corresponding to the quantized normalization value from a value corresponding to the magnitude of each of the samples to obtain a difference value and, when the difference value is positive and the value of each of the samples is positive, sets the difference value as a quantization candidate corresponding to the sample, when the difference value is positive and the value of each of the samples is negative, reverses the sign of the difference value and sets the sign-reversed value as an quantization candidate corresponding to the sample, and when the difference value is not positive, sets 0 as an quantization candidate corresponding to the sample; and a vector quantizer that jointly vector-quantizes a plurality of quantization candidates corresponding to the plurality of samples to obtain a vector quantization index, wherein the processing circuitry is configured to control transmission of the normalization-value quantization index to a decoding apparatus.

11. The coding apparatus according to claim 10, wherein:

the value corresponding to the magnitude of the sample is the absolute value of the value of the sample; and the value corresponding to the quantized normalization value is the product of the quantized normalization value and a first adjustment constant, the first adjustment constant being a predetermined positive value.

12. The coding apparatus according to claim 10 or 11, further comprising an quantization-candidate normalization value calculator that calculates a quantization-candidate normalization value, the quantization-candidate normalization value being representative of the quantization candidates;

wherein the vector quantizer jointly vector-quantizes normalized values to obtain a vector quantization index, the normalized values obtained by normalizing a plurality of quantization candidates corresponding to the plurality of samples with the quantization-candidate normalization value.

13. The coding apparatus according to claim 12, wherein the quantization-candidate normalization value is the product of the quantized normalization value and a second predetermined adjustment constant.

14. A decoding apparatus for decoding a coded audio signal comprising:

processing circuitry configured to implement a normalization value decoder that obtains a decoded normalization value corresponding to an input normalization-value quantization index, the normalization-value quantization index being received from a coding apparatus and generated based on an audio signal inputted to the coding apparatus;

a vector decoder that obtains a plurality of values corresponding to an input vector quantization index as a plurality of decoded values;

a normalization value recalculator that calculates a recalculated normalization value from decoded normalization values and decoded values those are not zero, the recalculated normalization value being specifically calculated to have a value which has a magnitude that is inversely related to a cumulative sum of the absolute values of a predetermined number of the decoded values;

a synthesizer that, when the decoded value is zero, obtains as a decoded signal a value having an absolute value that is the recalculated normalization value multiplied by a first constant, and when the decoded value is not zero, obtains as a decoded signal the linear sum of the decoded value or the absolute value of the decoded value and the decoded normalization value, the linear sum reflecting the sign of the decoded value, wherein the decoded signal obtained by the synthesizer is in the frequency domain; and a time domain converter that converts the decoded signal from the frequency domain to the time domain to reproduce an audio signal in the time domain that corresponds to the audio signal originally inputted to the coding apparatus.

15. The decoding apparatus according to claim 14, wherein the value having an absolute value that is the recalculated normalization value multiplied by the first constant is the recalculated normalization value multiplied by the first constant and has a randomly reversed sign.

16. The decoding apparatus according to claim 14, wherein:

the normalization value recalculator calculates the recalculated normalization value that is $\overline{X}$ defined by the following equation $$\overline{X} = \sqrt{\frac{C_0 \overline{X}^2 - tmp}{m}} \quad \text{[Equation 11]}$$

where $C_0$ is the predetermined number, $X^-$ is the decoded normalization value, tmp is the sum of squares of the sum of the absolute value of a decoded value that is not zero among the predetermined number of decoded values and the decoded normalization value, and m is the number of decoded values that are zero among the predetermined number of decoded values.

17. The decoding apparatus according to claim 14, wherein when each of the decoded values is not zero, the synthesizer adds the absolute value of the decoded value to the decoded normalization value multiplied by a first adjustment constant and multiplies the resulting value by the sign of the decoded value to obtain a decoded signal, the first adjustment constant being a predetermined positive value.

18. The decoding apparatus according to claim 14, wherein when the recalculated normalization value is not zero, the normalization value recalculator obtains as the recalculated normalization value a weighted sum of the recalculated normalization value and a recalculated normalization value obtained in the immediately preceding recalculation.

19. A non-transitory computer-readable recording medium on which a program for causing a computer to executes the steps of the method according to claim 1.

20. A decoding method for decoding a coded audio signal comprising:

a normalization value decoding step of obtaining a decoded normalization value corresponding to an input normalization-value quantization index, the normalization-value quantization index being received from a coding apparatus and generated based on an audio signal inputted to the coding apparatus;

a decoding-candidate normalization value calculating step of multiplying the decoded normalization value by a second constant to obtain a decoding-candidate normalization value;

the vector decoding step of multiplying each of a plurality of values corresponding to an input vector quantization index by the decoding-candidate normalization value to obtain a plurality of decoded values;

a normalization value recalculation step of calculating a recalculated normalization value from decoded normalization values and decoded values those are not zero, the recalculated normalization value being specifically calculated to have a value which has a magnitude that is inversely related to a cumulative sum of the absolute values of a predetermined number of the decoded values;

a combining step of, when the decoded value is zero, obtaining as a decoded signal a value having an absolute value that is the recalculated normalization value multiplied by a first constant, and when the decoded value is not zero, obtaining as a decoded signal the linear sum of the decoded value or the absolute value of the decoded value and the decoded normalization value, the linear sum reflecting the sign of the decoded value; and wherein the decoded signal from the combining step is in the frequency domain, and the method further includes converting the decoded signal from the frequency domain to the time domain to reproduce an audio signal in the time domain that corresponds to the audio signal originally inputted to the coding apparatus.

21. A decoding apparatus for decoding a coded audio signal comprising:

a normalization value decoder that obtains a decoded normalization value corresponding to an input normalization-value quantization index, the normalization-value quantization index being received from a coding apparatus and generated based on an audio signal inputted to the coding apparatus;

a decoding-candidate normalization value calculator that multiplies the decoded normalization value by a second constant to obtain a decoding-candidate normalization value;

the vector decoder that multiplies each of a plurality of values corresponding to an input vector quantization index by the decoding-candidate normalization value to obtain a plurality of decoded values;

a normalization value recalculator that calculates a recalculated normalization value from decoded normalization values and decoded values those are not zero, the recalculated normalization value being specifically calculated to have a value which has a magnitude that is inversely related to a cumulative sum of the absolute values of a predetermined number of the decoded values; and a synthesizer that, when the decoded value is zero, obtains as a decoded signal a value having an absolute value that is the recalculated normalization value multiplied by a first constant, and when the decoded value is not zero, obtains as a decoded signal the linear sum of the decoded value or the absolute value of the decoded value and the decoded normalization value, the linear sum reflecting the sign of the decoded value, wherein the decoded signal obtained by the synthesizer is in the frequency domain; and a time domain converter that converts the decoded signal from the frequency domain to the time domain to reproduce an audio signal in the time domain that corresponds to the audio signal originally inputted to the coding apparatus.

22. The decoding method according to claim 20, wherein the value having an absolute value that is the recalculated normalization value multiplied by the first constant is the recalculated normalization value multiplied by the first constant and has a randomly reversed sign.

23. The decoding method according to claim 20, wherein:

the normalization value recalculation step calculates the recalculated normalization value that is $\bar{\bar{X}}$ defined by the following equation $$\bar{\bar{X}} = \sqrt{\frac{C_0\bar{X}^2 - tmp}{m}} \quad \text{[Equation 10]}$$

where $C_0$ is the predetermined number, $\bar{X}$ is the decoded normalization value, tmp is the sum of squares of the sum of the absolute value of a decoded value that is not zero among the predetermined number of decoded values and the decoded normalization value, and m is the number of decoded values that are zero among the predetermined number of decoded values.

24. The decoding method according to claim 20, wherein when each of the decoded values is not zero, the combining step adds the absolute value of the decoded value to the decoded normalization value multiplied by a first adjustment constant and multiplies the resulting value by the sign of the decoded value to obtain a decoded signal, the first adjustment constant being a predetermined positive value.

25. The decoding method according to claim 20, wherein when the recalculated normalization value is not zero, the normalization value recalculation step obtains as the recalculated normalization value a weighted sum of the recalculated normalization value and a recalculated normalization value obtained in the immediately preceding recalculation.

26. The decoding apparatus according to claim 21, wherein the value having an absolute value that is the recalculated normalization value multiplied by the first constant is the recalculated normalization value multiplied by the first constant and has a randomly reversed sign.

27. The decoding apparatus according to claim 21, wherein:

the normalization value recalculator calculates the recalculated normalization value that is $\bar{\bar{X}}$ defined by the following equation $$\bar{\bar{X}} = \sqrt{\frac{C_0\bar{X}^2 - tmp}{m}} \quad \text{[Equation 11]}$$

where $C_0$ is the predetermined number, $\bar{X}$ is the decoded normalization value, tmp is the sum of squares of the sum of the absolute value of a decoded value that is not zero among the predetermined number of decoded values and the decoded normalization value, and m is the number of decoded values that are zero among the predetermined number of decoded values.

28. The decoding apparatus according to claim 21, wherein when each of the decoded values is not zero, the synthesizer adds the absolute value of the decoded value to the decoded normalization value multiplied by a first adjustment constant and multiplies the resulting value by the sign of the decoded value to obtain a decoded signal, the first adjustment constant being a predetermined positive value.

29. The decoding apparatus according to claim 21, wherein when the recalculated normalization value is not zero, the normalization value recalculator obtains as the recalculated normalization value a weighted sum of the recalculated normalization value and a recalculated normalization value obtained in the immediately preceding recalculation.

30. A non-transitory computer-readable recording medium on which a program for causing a computer to executes the steps of the method according to claim 20.

* * * * *